US010393474B2

(12) United States Patent
Sullivan

(10) Patent No.: US 10,393,474 B2
(45) Date of Patent: Aug. 27, 2019

(54) HIGH CAPACITY PROJECTILE LOADER

(71) Applicant: United Tactical Systems, LLC, Lake Forest, IL (US)

(72) Inventor: Brian Edward Sullivan, Alta Loma, CA (US)

(73) Assignee: United Tactical Systems, LLC, Lake Forest, IL (US)

( * ) Notice: Subject to any disclaimer, the term of this patent is extended or adjusted under 35 U.S.C. 154(b) by 0 days.

(21) Appl. No.: 15/872,687

(22) Filed: Jan. 16, 2018

(65) Prior Publication Data

US 2018/0202749 A1 Jul. 19, 2018

Related U.S. Application Data

(60) Provisional application No. 62/446,610, filed on Jan. 16, 2017.

(51) Int. Cl.

| | |
|---|---|
| ***F41B 11/00*** | (2013.01) |
| ***F41B 11/54*** | (2013.01) |
| ***F41A 9/73*** | (2006.01) |
| ***F41A 9/77*** | (2006.01) |
| ***F41B 11/50*** | (2013.01) |

(52) U.S. Cl.

CPC ..... *F41B 11/54* (2013.01); *F41A 9/73* (2013.01); *F41A 9/77* (2013.01); *F41B 11/50* (2013.01)

(58) Field of Classification Search

CPC ..... F41B 7/006; F41B 11/54

See application file for complete search history.

(56) References Cited

U.S. PATENT DOCUMENTS

| | | | |
|---|---|---|---|
| 4,487,103 | A | 12/1984 | Atchisson |
| 4,658,700 | A | 4/1987 | Sullivan |
| 5,905,224 | A | 5/1999 | Jordan |
| 8,839,706 | B1 | 9/2014 | Macy |
| 9,429,385 | B1 | 8/2016 | Allen et al. |
| 2007/0107592 | A1 | 5/2007 | Snow |
| 2007/0151440 | A1 | 7/2007 | Cook et al. |
| 2010/0293830 | A1 | 11/2010 | Winge |

OTHER PUBLICATIONS

International Search Report of PCT/US2018/13871 dated May 14, 2018 (2 pages).

Written Opinion of the International Searching Authority of PCT/US2018/13871 dated May 14, 2018 (5 pages).

*Primary Examiner* — John A Ricci

(74) *Attorney, Agent, or Firm* — Barnes and Thornburg LLP

(57) ABSTRACT

A high capacity loader for sequentially loading a plurality of projectiles into a launcher. The loader has a first drive core, a second drive core and a load path to maintain the projectiles in a defined path around the first and second drive cores. The second drive core is rotationally connected to the first drive core. An indexing assembly is provided to index the drive cores. A drive assembly provides a rotational force for the drive cores. A magazine extends from the housing to connect the loader to the launcher and to load the projectiles into the launcher. The projectiles are individually indexed on the first and second drive cores and are free from force by adjacent projectiles.

19 Claims, 16 Drawing Sheets

HIGH CAPACITY PROJECTILE LOADER

CROSS-REFERENCE TO RELATED APPLICATIONS

This application claims the benefit of U.S. Provisional Patent Application No. 62/446,610, filed Jan. 16, 2017, which is expressly incorporated herein by reference and made a part hereof.

FEDERALLY SPONSORED RESEARCH OR DEVELOPMENT

Not Applicable.

TECHNICAL FIELD

The present disclosure relates generally to a projectile loader for guns, and more specifically to a high capacity projectile loader that accepts different shaped projectiles.

BACKGROUND

Projectile loaders for guns, and specifically paintball guns and other frangible projectile launchers, are well known in the art. While such projectile loaders according to the prior art provide a number of advantages, they nevertheless have certain limitations. The present invention seeks to overcome certain of these limitations and other drawbacks of the prior art, and to provide new features not heretofore available. A full discussion of the features and advantages of the present invention is deferred to the following detailed description, which proceeds with reference to the accompanying drawings.

SUMMARY

According to one embodiment, the disclosed subject technology relates to a high capacity loader for sequentially loading a plurality of projectiles into a launcher.

The disclosed subject technology further relates to a high capacity loader for sequentially loading a plurality of projectiles into a launcher, comprising: an outer housing; a first drive core in the outer housing rotating on a first drive shaft; a second drive core in the outer housing rotating on a second drive shaft, the second drive core being adjacent the first drive core, the second drive core rotationally connected to the first drive core; a front plate providing an internal closure at a first side of the loader; a rear plate providing an internal closure at a second side of the loader; a divider to retain the projectiles in a defined load path around the first and second drive cores; an indexing assembly that indexes the first and second drive cores; a drive assembly that provides a rotational force for the first drive core and the second drive core, the drive assembly rotationally connecting the first drive shaft to the second drive shaft and providing a drive force to rotate the first drive shaft and second drive shaft; and, a magazine adapted to connect the outer housing to the launcher and to feed the projectiles in the loader into the launcher.

The disclosed subject technology further relates to a high capacity loader for sequentially loading a plurality of projectiles into a launcher, comprising: a housing; a first drive core in the housing, the first drive core having a load path to maintain the projectiles in a defined path around the first drive core; an indexing assembly for indexing the first drive core; a drive assembly for providing a rotational force for the first drive core; and, a magazine extending from the housing to connect the loader to the launcher and to load the projectiles into the launcher, wherein the projectiles are individually indexed on the first drive core and are free from loading by adjacent projectiles on the drive core.

The disclosed subject technology further relates to a high capacity loader for sequentially loading a plurality of projectiles into a launcher, comprising: a first drive core; a second drive core and adjacent the first drive core, the second drive core rotationally connected to the first drive core, the first and second drive cores having a plurality of longitudinal concave receivers about their circumferences; a load path to maintain the projectiles in a defined path around the first and second drive cores; an indexing assembly for indexing the first and second drive cores; a drive assembly for providing a rotational force for the first and second drive cores; and, a magazine extending from the housing to connect the loader to the launcher and to load the projectiles into the launcher, wherein the projectiles are individually indexed on the first and second drive cores and are free from force by adjacent projectiles on the drive cores.

The disclosed subject technology further relates to a high capacity loader wherein the projectiles in the load path are not under compression or tension force around the first and second drive cores.

The disclosed subject technology further relates to a high capacity loader wherein the high capacity loader is maintained in an indexing state during use and during of non-use.

The disclosed subject technology further relates to a high capacity loader having a loader plate to transition the projectiles from the load path into the magazine.

The disclosed subject technology further relates to a high capacity loader wherein the first and second drive cores have a plurality of concave receivers about a circumference of the first and second drive cores, respectively.

The disclosed subject technology further relates to a high capacity loader wherein the outer housing comprises a front outer housing and a rear outer housing that are secured together.

The disclosed subject technology further relates to a high capacity loader wherein the divider comprises a plurality of channel guides and an outer guide.

The disclosed subject technology further relates to a high capacity loader wherein the indexing assembly is provided adjacent the second side of the loader. In one embodiment, the indexing assembly has an actuator in the magazine that is driven by the launcher, and wherein the indexing assembly further has a rachet mechanism that indexes the first drive core.

The disclosed subject technology further relates to a high capacity loader wherein the drive assembly comprises a spring around one of the first and the second drive shafts, and wherein the spring is loaded during insertion of the projectiles into the loader. In one embodiment, the drive assembly comprises a spring loaded drive on the second drive shaft, and a drive belt connecting the second drive shaft and the first drive shaft.

The disclosed subject technology further relates to a high capacity loader wherein the first drive shaft and the second drive shaft are connected to the front plate and rear plate, respectively, to retain the first drive shaft, with the first drive core attached thereto, and the second drive shaft, with the second drive core attached thereto, in the appropriate locations.

The disclosed subject technology further relates to a high capacity loader having a feed follower comprising a plurality of dummy projectiles connected to one another in series, the feed follower being inserted into the load path. In one embodiment, the first projectile of the feed follower has a larger shape to be captured in the magazine prior to exit from the magazine.

The disclosed subject technology further relates to a high capacity loader having a second drive core in the housing and adjacent the first drive core, the second drive core rotationally connected to the first drive core, and a load path defined by dividers to retain the projectiles in a defined path on the first and second drive cores.

The disclosed subject technology further relates to a high capacity loader having a loader plate to transition the projectiles into a magazine extending from the housing.

The disclosed subject technology further relates to a high capacity loader wherein the load path is defined by a divider on an exterior of the drive cores. In one embodiment, the load path has a helical shape around the drive cores.

It is understood that other embodiments and configurations of the subject technology will become readily apparent to those skilled in the art from the following detailed description, wherein various configurations of the subject technology are shown and described by way of illustration. As will be realized, the subject technology is capable of other and different configurations and its several details are capable of modification in various other respects, all without departing from the scope of the subject technology. Accordingly, the drawings and detailed description are to be regarded as illustrative in nature and not as restrictive.

BRIEF DESCRIPTION OF THE DRAWINGS

To understand the present disclosure, it will now be described by way of example, with reference to the accompanying drawings in which embodiments of the disclosures are illustrated and, together with the descriptions below, serve to explain the principles of the disclosure.

DETAILED DESCRIPTION

Figure 1:
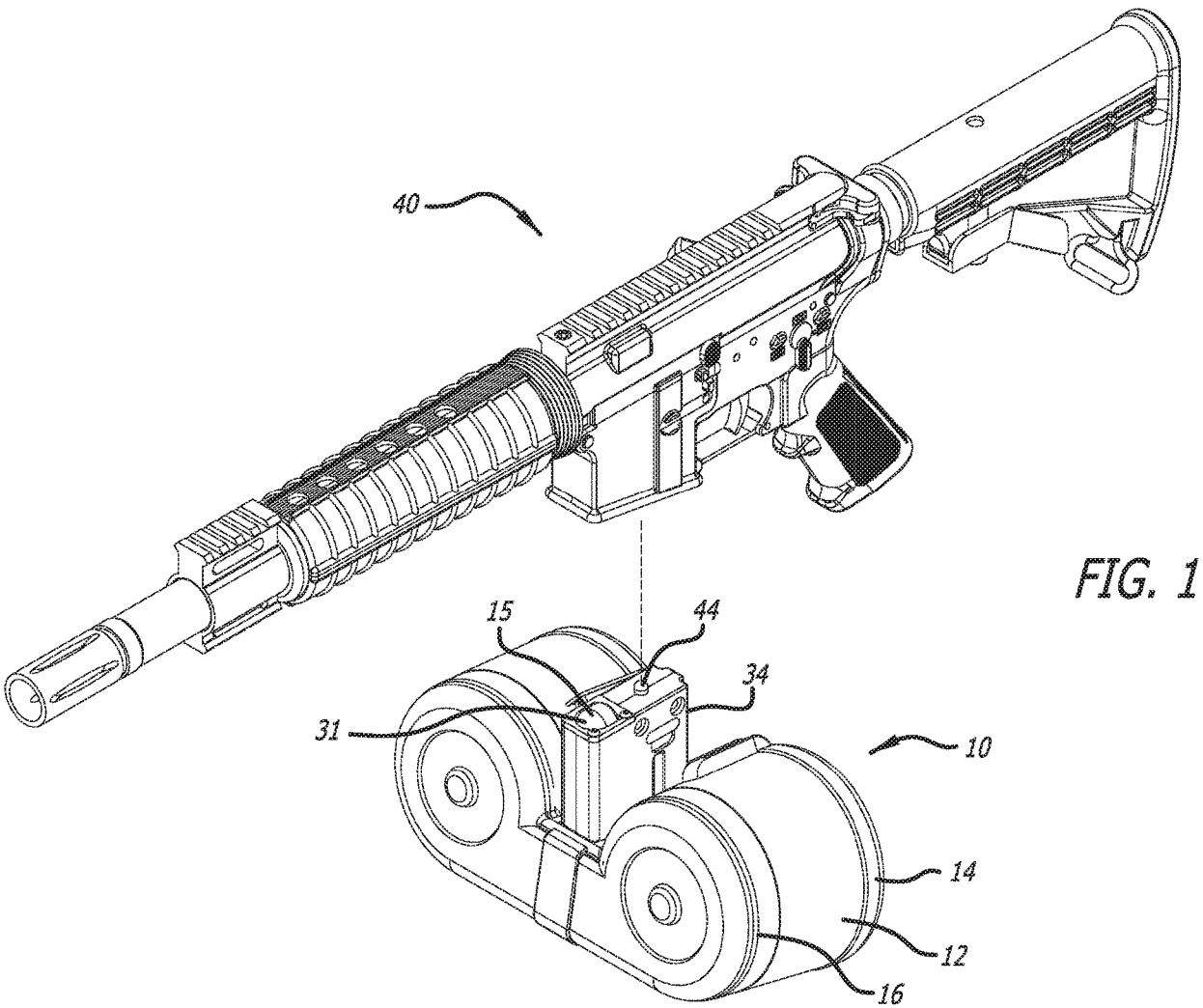
FIG. 1 is a front perspective view of a projectile loader for connection to a launcher according to one embodiment.

While the high capacity projectile loader discussed herein is susceptible of embodiments in many different forms, there is shown in the drawings, and will herein be described in detail, preferred embodiments with the understanding that the present description is to be considered as an exemplification of the principles of the high capacity projectile loader and is not intended to limit the broad aspects of the disclosure to the embodiments illustrated.

Figure 2:
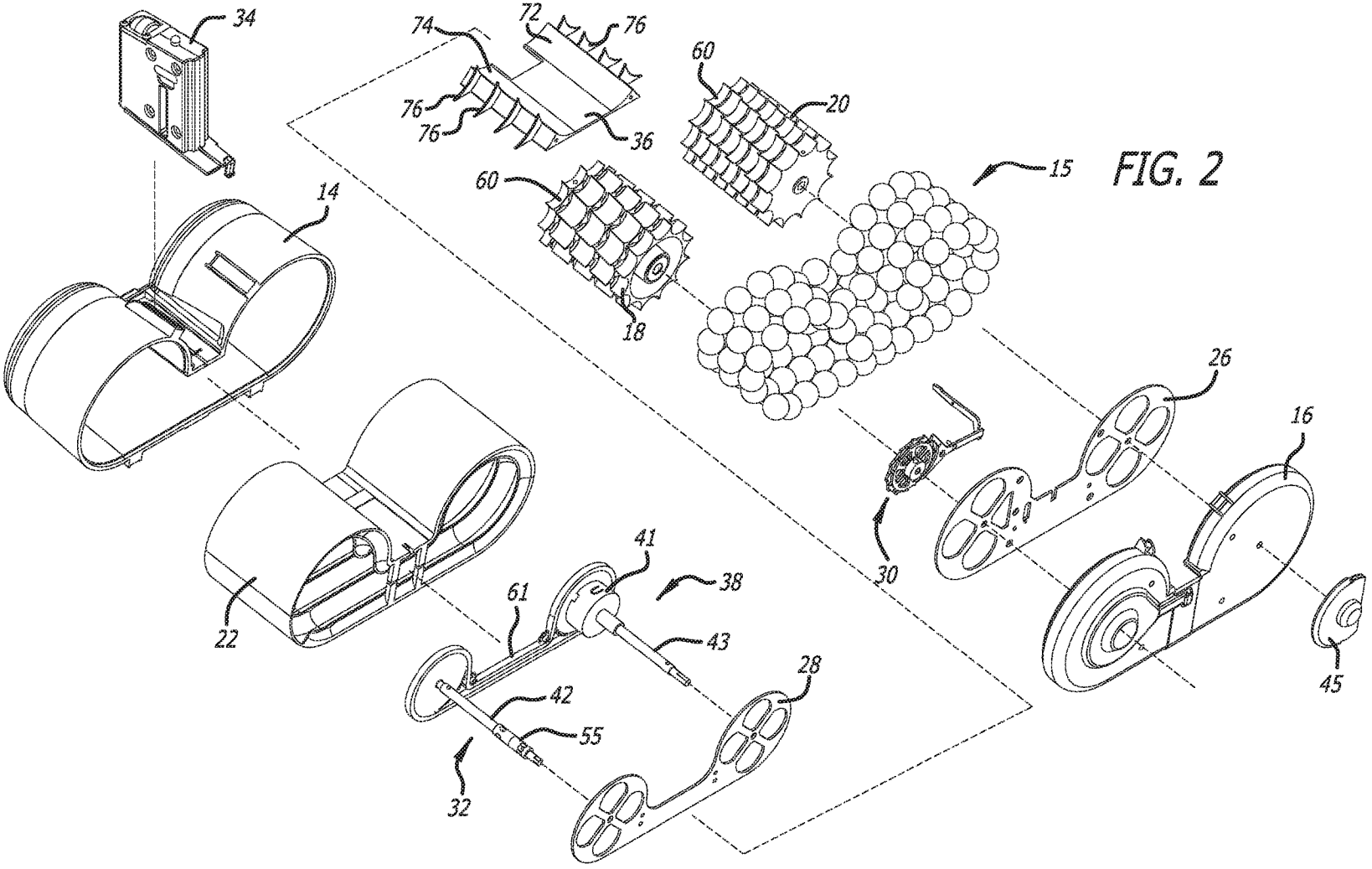
FIG. 2 is an exploded rear perspective view of the projectile loader of FIG. 1 according to one embodiment.
Figure 3:
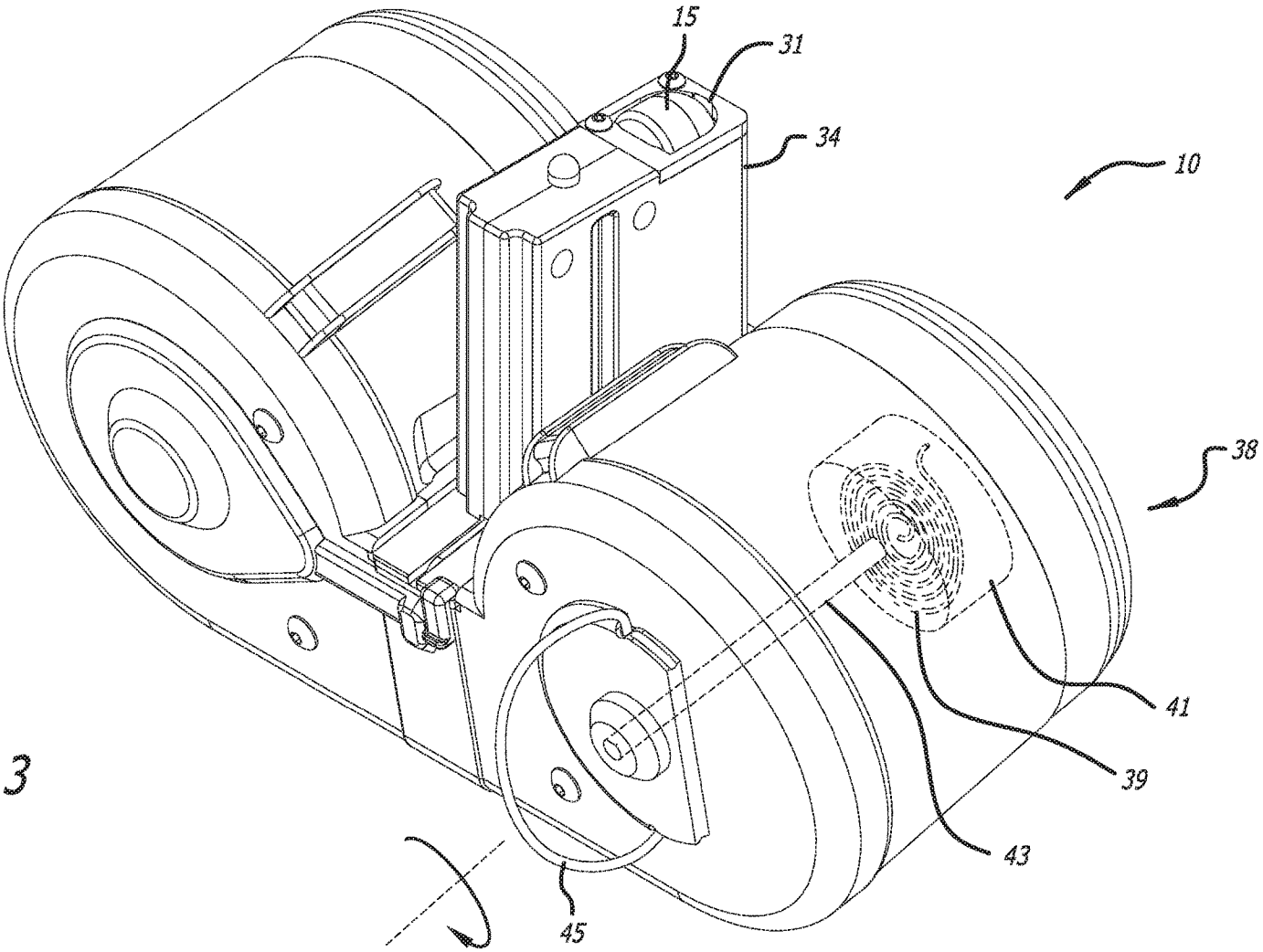
FIG. 3 is a rear perspective view of the projectile loader of FIG. 1.
Figure 4:
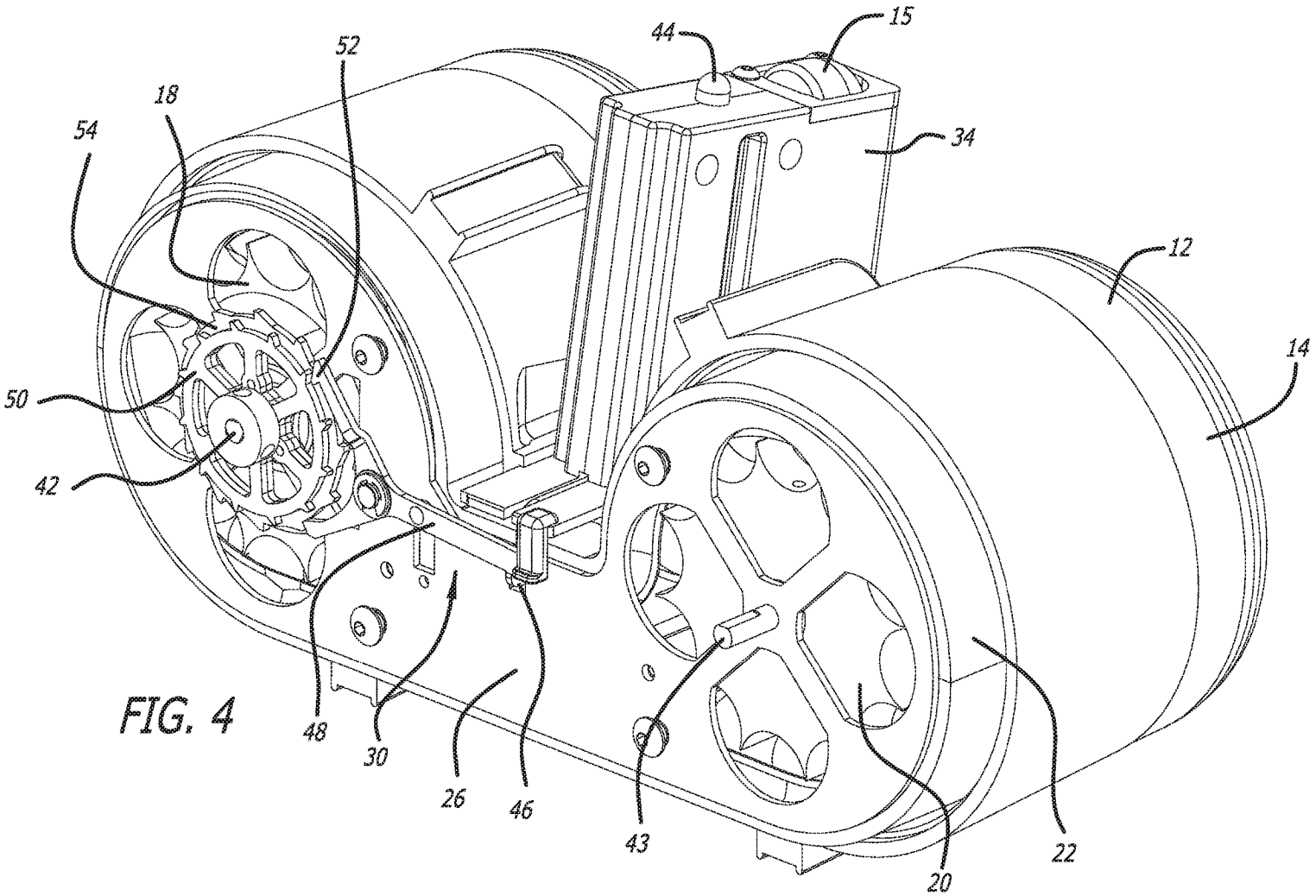
FIG. 4 is a rear perspective view of the projectile loader of FIG. 1 with the rear outer housing removed.

Referring now to the figures, and initially to FIGS. 1-3, in one embodiment there is shown a high capacity projectile loader 10 for loading projectiles 15 into a gun or launcher 40, such as a paintball gun or frangible projectile launcher. The high capacity projectile loader 10 can handle a large amount of projectiles, such as for example 100 projectiles or more. Additionally, the high capacity loader 10 is able to accept different shaped projectiles. For example, the loader 10 can accept standard round projectiles, and the same loader 10 can accept projectiles that have both a cylindrical and a semi-hemispherical shape as shown in FIG. 2, as well as additional alternate shapes. Additionally, because the projectile loader does not place stress or loads on the projectiles in the load path, the loader can operate with both rigid and non-rigid projectiles.

Figure 16:
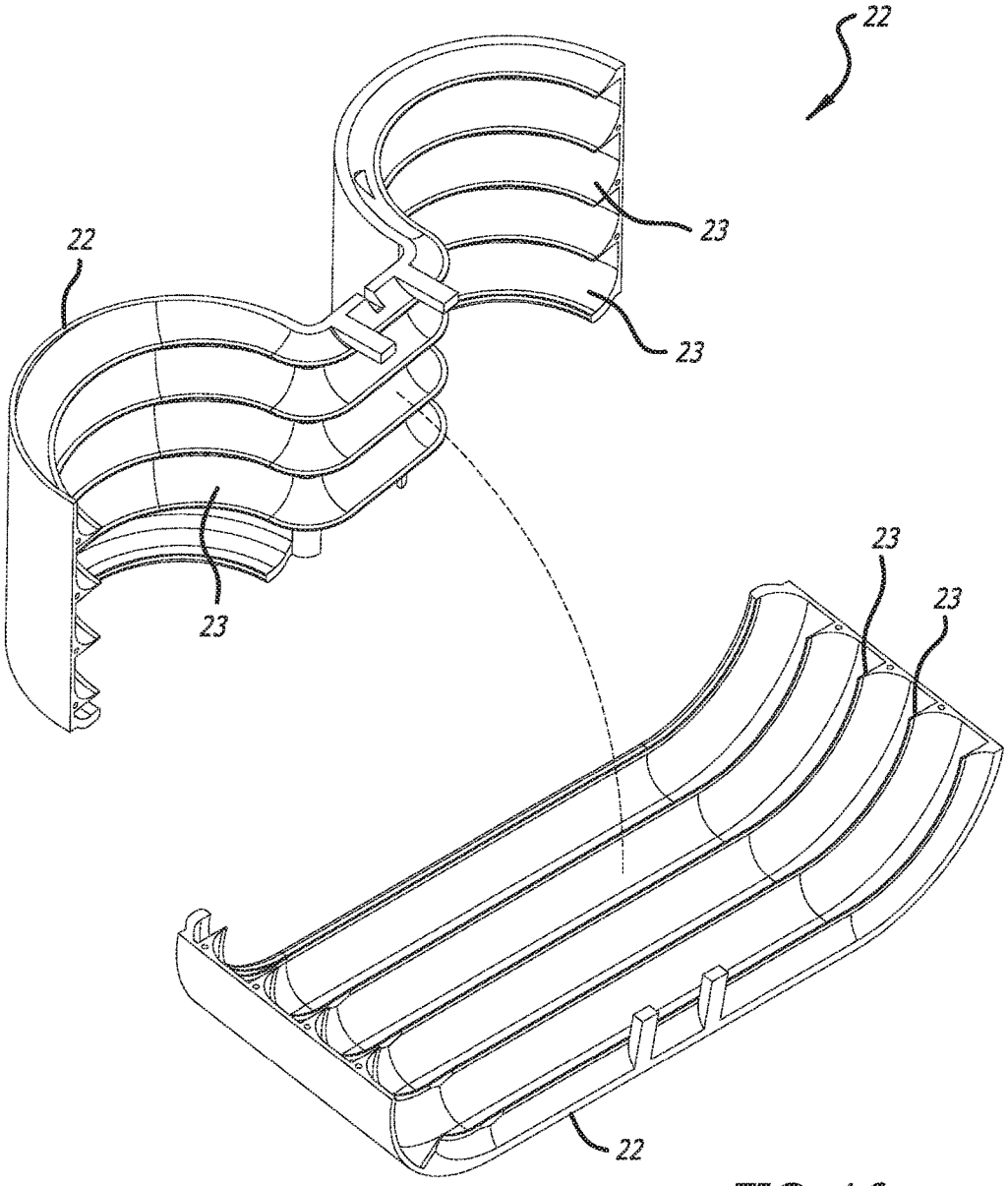
FIG. 16 is a partially exploded perspective view of the divider housing according to one embodiment.

As shown in the figures, the loader 10 generally comprises an outer housing 12, which may include a front outer housing 14 connected to a rear outer housing 16, a first drive core 18, a second drive core 20, a divider 22 to retain the projectiles in a defined load path around the first and second drive cores 18, 20, a rear plate 26 at a rear (or second end) of the drive cores 18, 20, a front plate 28 at a front (or first end) of the drive cores 18, 20, an indexing assembly 30 adjacent the second end of the drive cores 18, 20, a drive assembly 32 adjacent a first end of the drive cores 18, 20, a magazine 34, and a loader plate 36. In one embodiment the divider 22 comprises a spring (not shown) around the two drive cores 18, 20 to define the load paths, and a sleeve (not shown) around the spring. In another embodiment, as shown in FIG. 16, the divider 22 comprises an inner housing having divider members or channel guides that define the load path around the two drive cores 18, 20.

Figure 12:
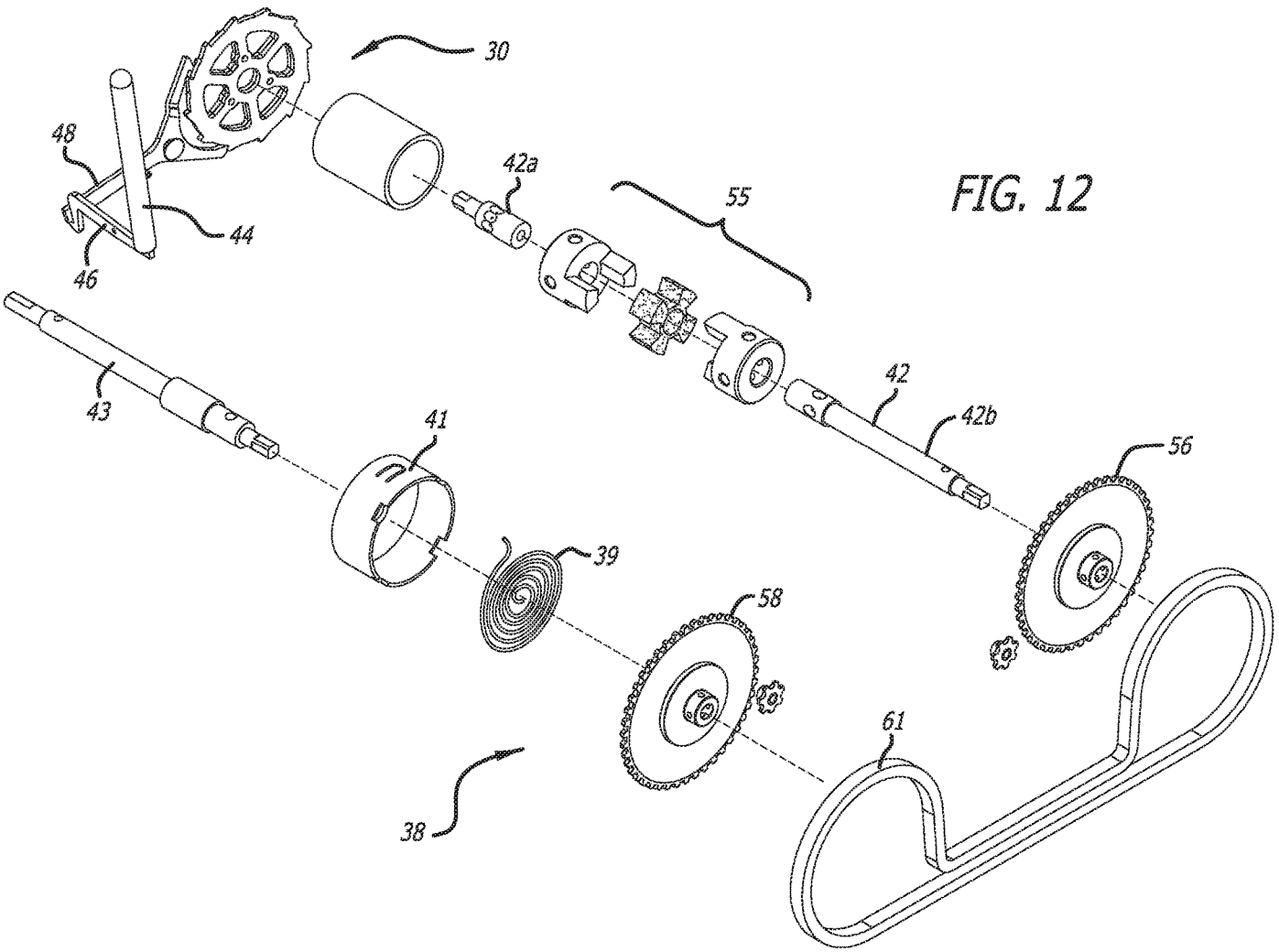
FIG. 12 is a partial front exploded perspective view of the drive assembly and indexing assembly for the projectile loader according to one embodiment.

The loader 10 is typically pre-tensioned by a user, for example by turning a pre-tensioning mechanism 38, such as shown in FIGS. 2 and 12. Following the pre-tensioning, when the projectiles 15 are loaded into the loader 10 the crank 45 is turned to fully load the spring 39 the proper amount for the number of projectiles 15 inserted into the loader 10. Accordingly, the pre-tensioning mechanism 38 can also be referred to as a force loading mechanism 38. In one embodiment the pre-tensioning mechanism 38 comprises a spring 39, such as a clock spring 39 or other internal coil spring, that has one end connected to the second shaft 43 and the other end connected to a drum 41 positioned around the clock spring 39. The drum 41 is fixed to the front plate 28 and does not rotate. Accordingly, when the second shaft 43 is rotated with the crank 45, as explained here to both pretension the loader and to load the loader, the clock spring 39 will be placed under tension and will exert a force to rotate the drive cores 18, 20 to operate the loader 10 in use. In one embodiment, the pre-tensioning mechanism 38 is directly connected to the second drive shaft 43 and is indirectly connected to the first drive shaft 42 with a drive belt 61 or drive chain 61. The pre-tensioning mechanism 38, and specifically the spring 39, is further loaded during insertion of the projectiles into the loader 10 as part of the force loading mechanism operation. Specifically, as the projectiles are loaded into the loader 10, in the reverse order that they are dispensed, the crank 45 must be rotated to rotate the drive cores 18, 20 in the opposite rotational direction as when they rotate to dispense the projectiles. By rotating the crank 45 in the opposite direction as the direction of dispensing, the spring 39 is loaded a sufficient amount for the number of projectiles inserted into the loader.

As shown in FIG. 1 the loader 10 is designed to connect to a gun/launcher via the magazine 34 for delivering the projectiles into the breach of the launcher. Different magazines 34, each designed specifically for connection to a specific launcher, can be connected to the same loader 10 so that a single loader 10 can be connected to different launchers. Additionally, the loader 10 is designed to accommodate different firing systems of different launchers (e.g., mechanical, pneumatic or electronic). The embodiment shown herein is for a mechanical firing system. Accordingly, as shown in FIGS. 6, 7 and 9-12, the indexing assembly 30 in the embodiment shown receives an input from the bolt assembly of the launcher 40 following each firing of a projectile from the launcher to index the loader 10 one projectile, via the force provided by the pre-tensioning mechanism 38, to thereby load the next projectile into the breach of the launcher for firing. Further, as explained herein, the loader 10 does not place the projectiles under stress, so the projectiles in the loader can be staged for extended storage periods and a variety of projectile types can be used with the same loader 10.

In one embodiment, the first and second drive cores 18, 20 are supported by shafts retained by the rear plate 26 at a rear (or second end) of the drive cores 18, 20, and a front plate 28 at a front (or first end) of the drive cores 18, 20. Specifically, in one embodiment the first drive core 18 is supported by a first drive shaft 42 and the second drive core 20 is supported by a second drive shaft 43. The second drive shaft 43 has the pre-tensioning mechanism 38 connected thereto, and the first drive shaft 42 has the indexing assembly 30 connected thereto. Accordingly, in one embodiment, the input force to rotate the first and second drive shafts 42, 43 is provided by the pre-tensioning mechanism 38, and the timing for such rotation is provided by the indexing assembly 30. In one embodiment, the indexing assembly 30 receives an input from the launcher 40, such as from the bolt assembly of the launcher 40.

Figure 9:
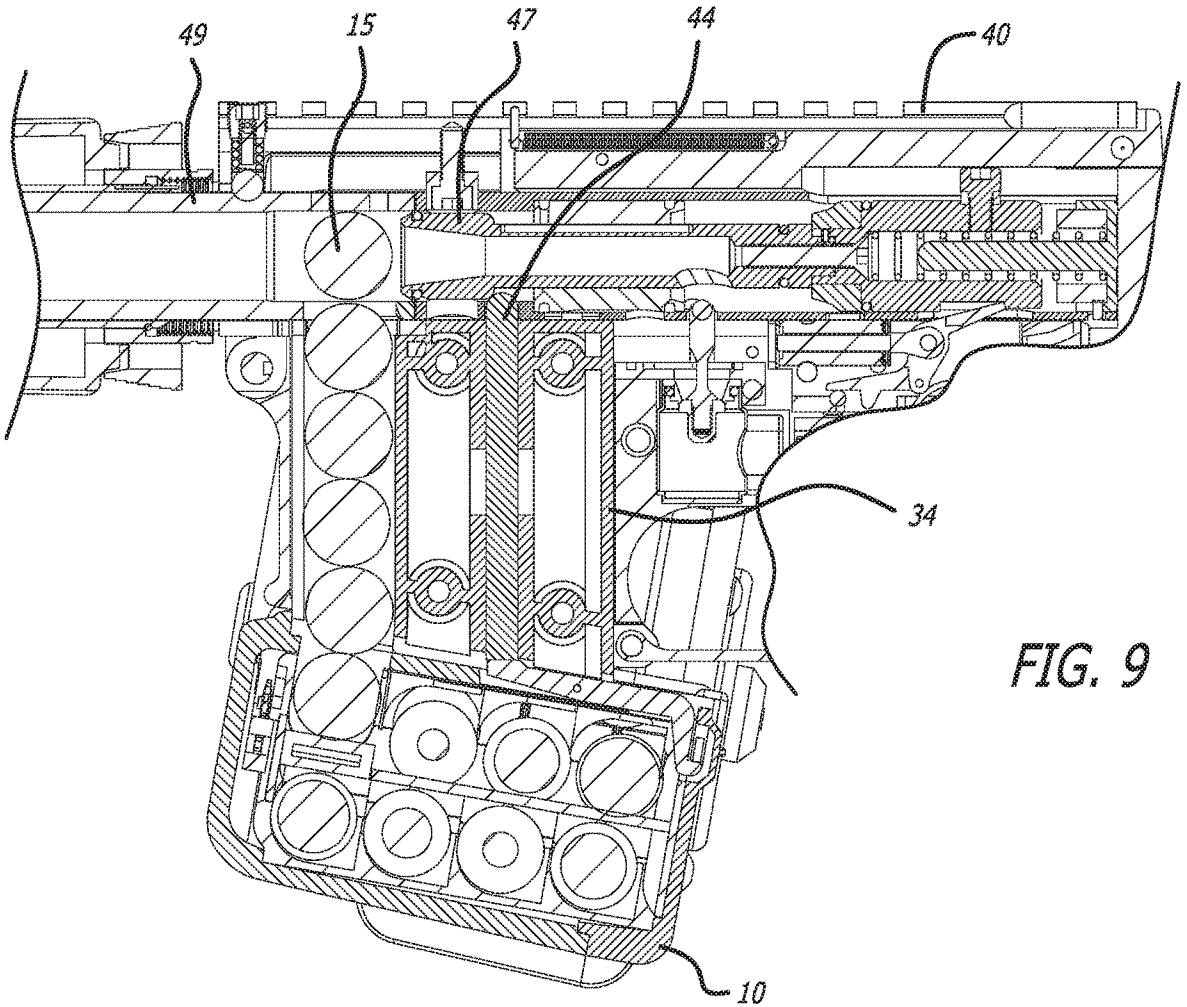
FIG. 9 is a cross-sectional side view of the projectile loader of FIG. 1 demonstrating a projectile that has been placed into the launcher barrel by the loader.
Figure 10:
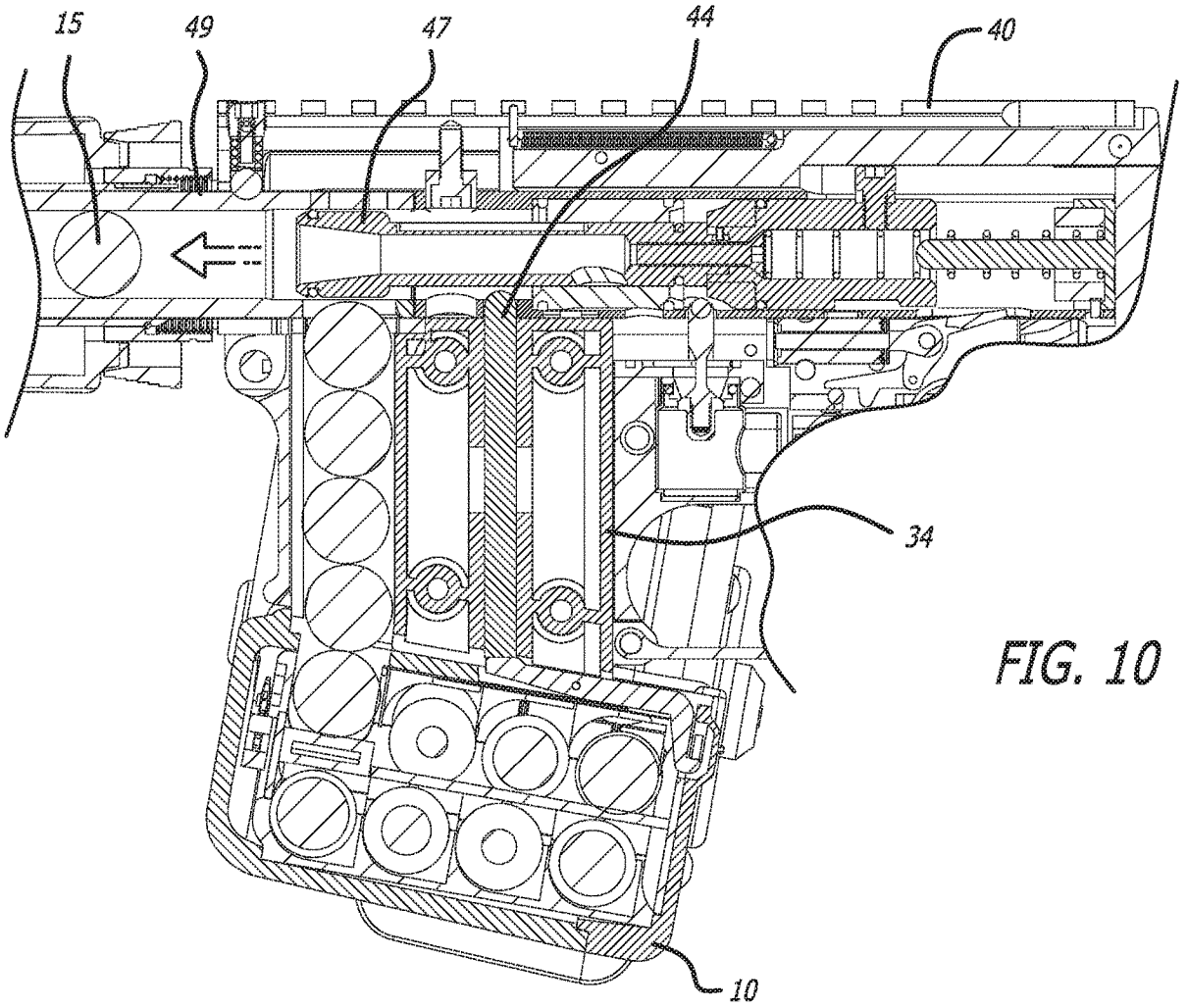
FIG. 10 is a cross-sectional side view of the projectile loader of FIG. 1 demonstrating the launching of a projectile that was placed in the launcher barrel in FIG. 9.
Figure 11:
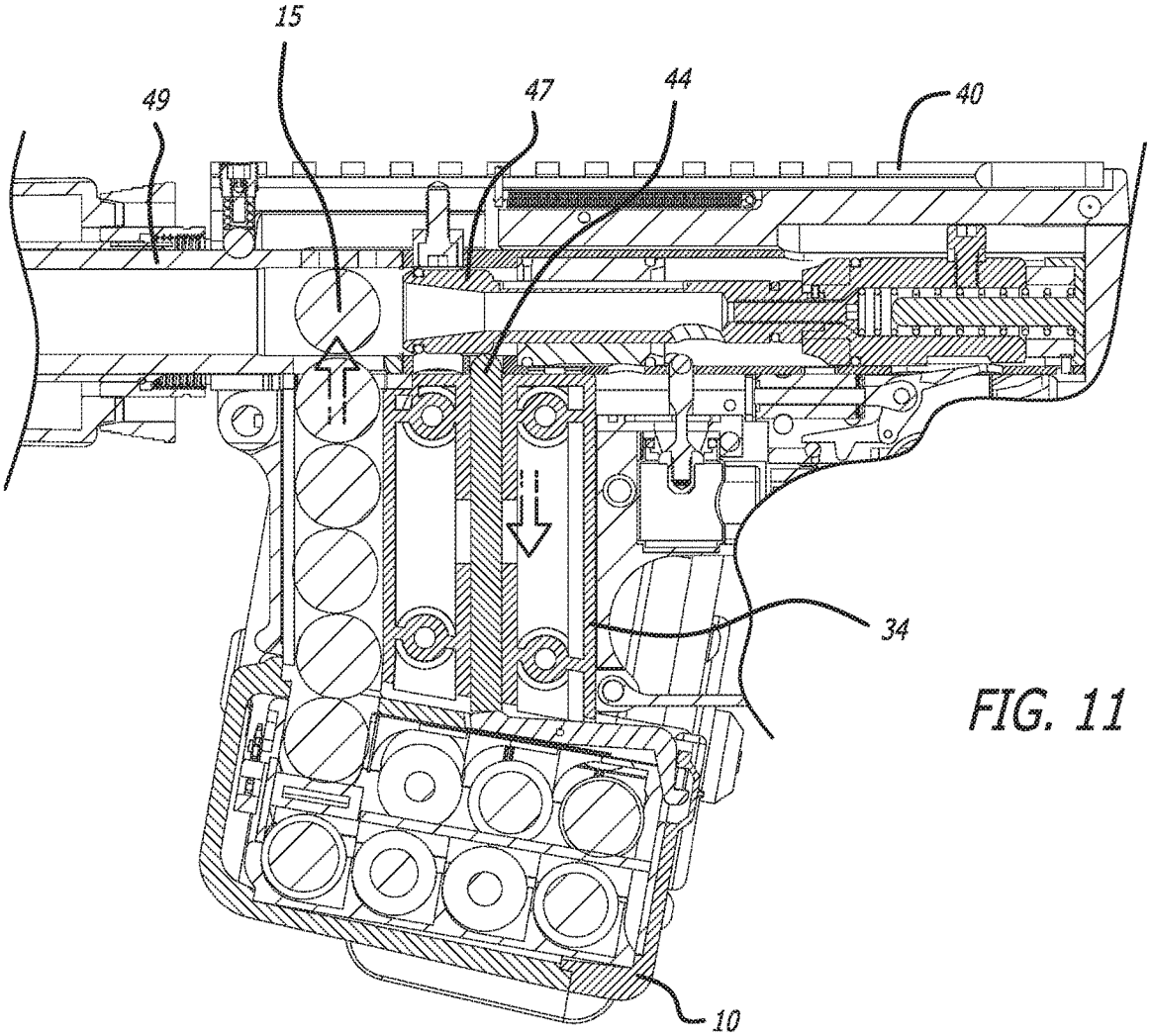
FIG. 11 is a cross-sectional side view of the projectile loader of FIG. 1 demonstrating the actuation of the indexing assembly to index a projectile into the launcher barrel following the launching of the prior projectile.

As shown in FIGS. 2, 6, 7 and 9-12, in one embodiment, the indexing assembly 30 is a ratchet mechanism comprising an actuator 44 that receives the input from the launcher 40, a lower link 46 connected to the actuator 44, a first pawl 48 connected to the lower link 46, wherein the first pawl 48 drives an outer cog 50, a second pawl 52 connected to the first pawl 48, and wherein the second pawl 52 operates as a stop for an inner cog 54 that is fixed to the outer cog 50. Referring to FIG. 9, this drawing illustrates the loader 10 attached to the launcher 40 and a projectile in the breach of the barrel 49. In FIG. 10 the bolt 47 forces the projectile out of the barrel 49 of the launcher 40. In FIGS. 9 and 10 it is seen that a small gap exists between the bolt 47 and the actuator 44 in the magazine 34 of the loader 10. As the bolt 47 returns to its prefiring location the bolt 47 engages the actuator 44 and forces the actuator 44 downwardly. When the actuator 44 receives this input from the launcher 40 the lower link 46 of the indexing assembly 30 operates to actuate the first pawl 48, which advances the outer cog 50 one unit of rotation and the second pawl 52 operates as a stop against the inner cog 54 to prevent opposite rotation of the system. The outer cog 50 is connected to the drive shaft 42 to correspondingly rotate the drive shaft 42 one unit of rotation. Thus, upon receiving an input from the launcher 40, the indexing assembly 30 indexes the drive shaft 42 one unit of rotation. This occurs after each firing of a projectile and returning of the bolt 47 back to its prefiling location, which, as shown in FIG. 11, operates to actuate the actuator 44 of the indexing assembly 30. Of course, the loader 10 is pre-tensioned via the pre-tensioning mechanism 38 such that the indexing assembly 30 does not necessarily provide the rotation force, but the pre-tensioning of the first and second drive shafts 42, 43 provides the force and the indexing assembly 30 provides the timing and allows for the movement. In a preferred embodiment, as shown in FIGS. 2, 6, 7 and 9-12, the indexing assembly 30 is located at the second end of the loader 10, and the pre-tensioning assembly 38 is located adjacent the first end of the loader 10, however, the pre-tensioning assembly 38 could easily be located adjacent the second end of the loader 10.

Figure 5:
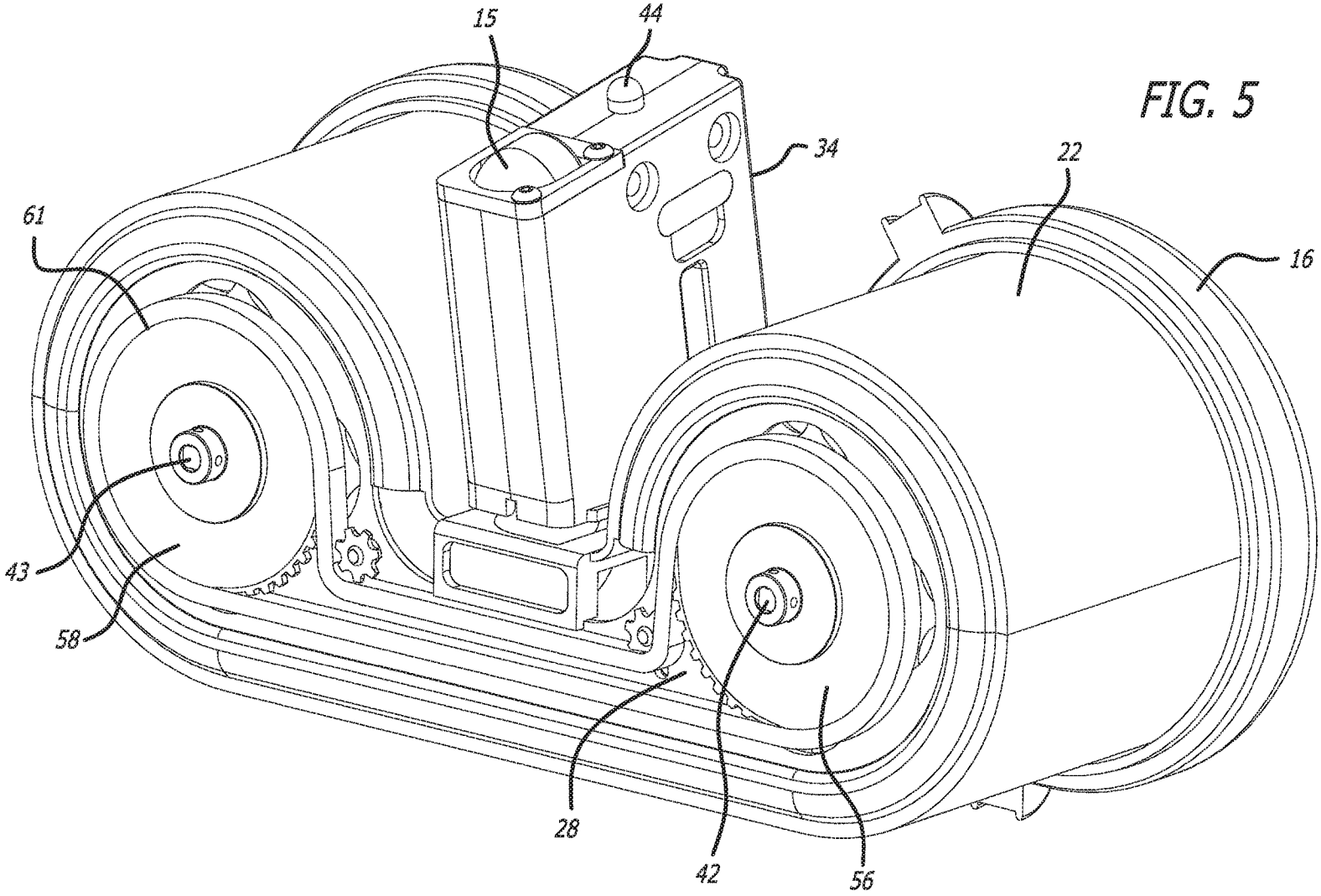
FIG. 5 is a front perspective view of the projectile loader of FIG. 1 with the outer housing removed.
Figure 6:
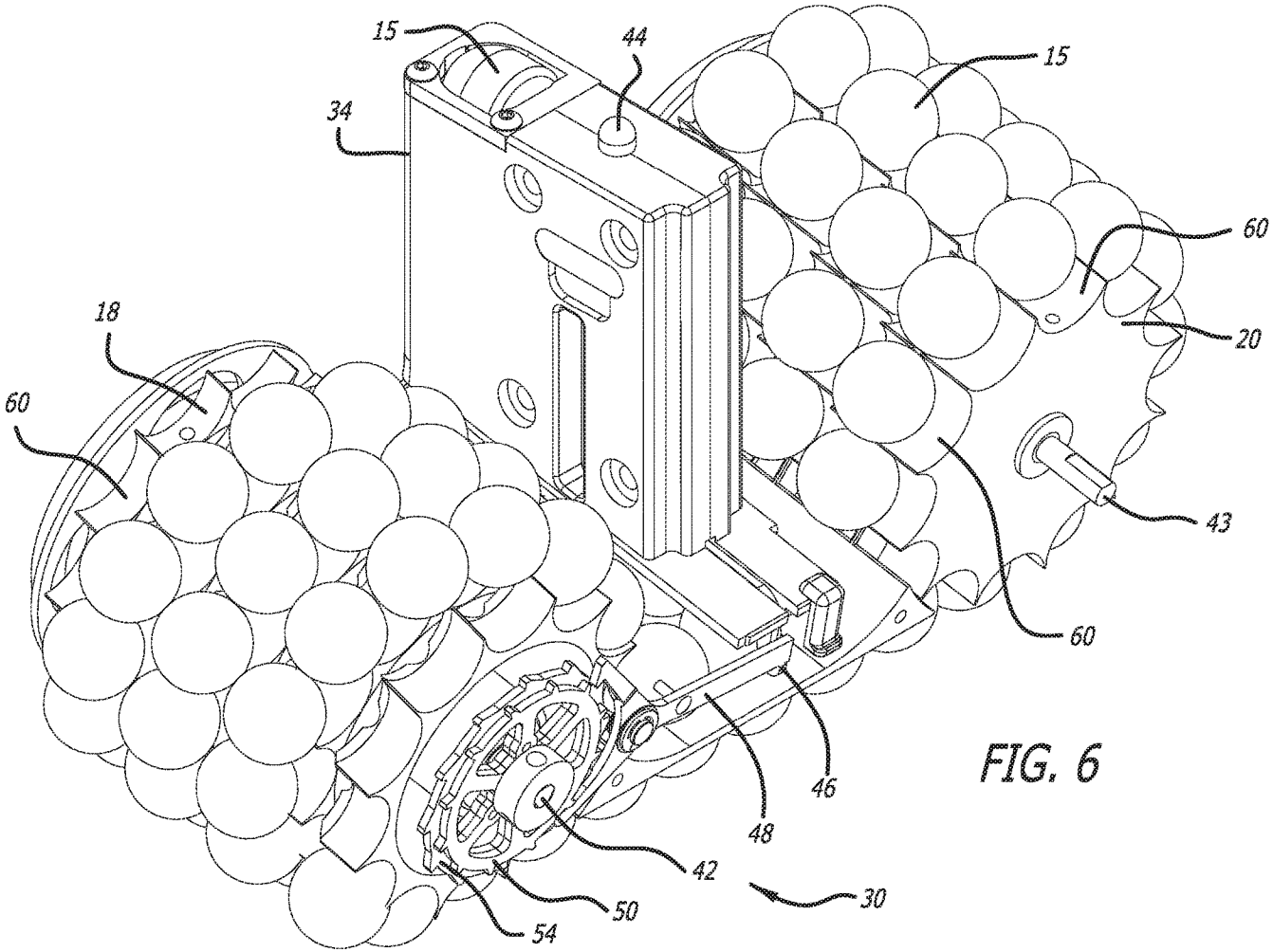
FIG. 6 is a rear perspective view of the projectile loader of FIG. 1 with the outer housing and divider housing removed.
Figure 7:
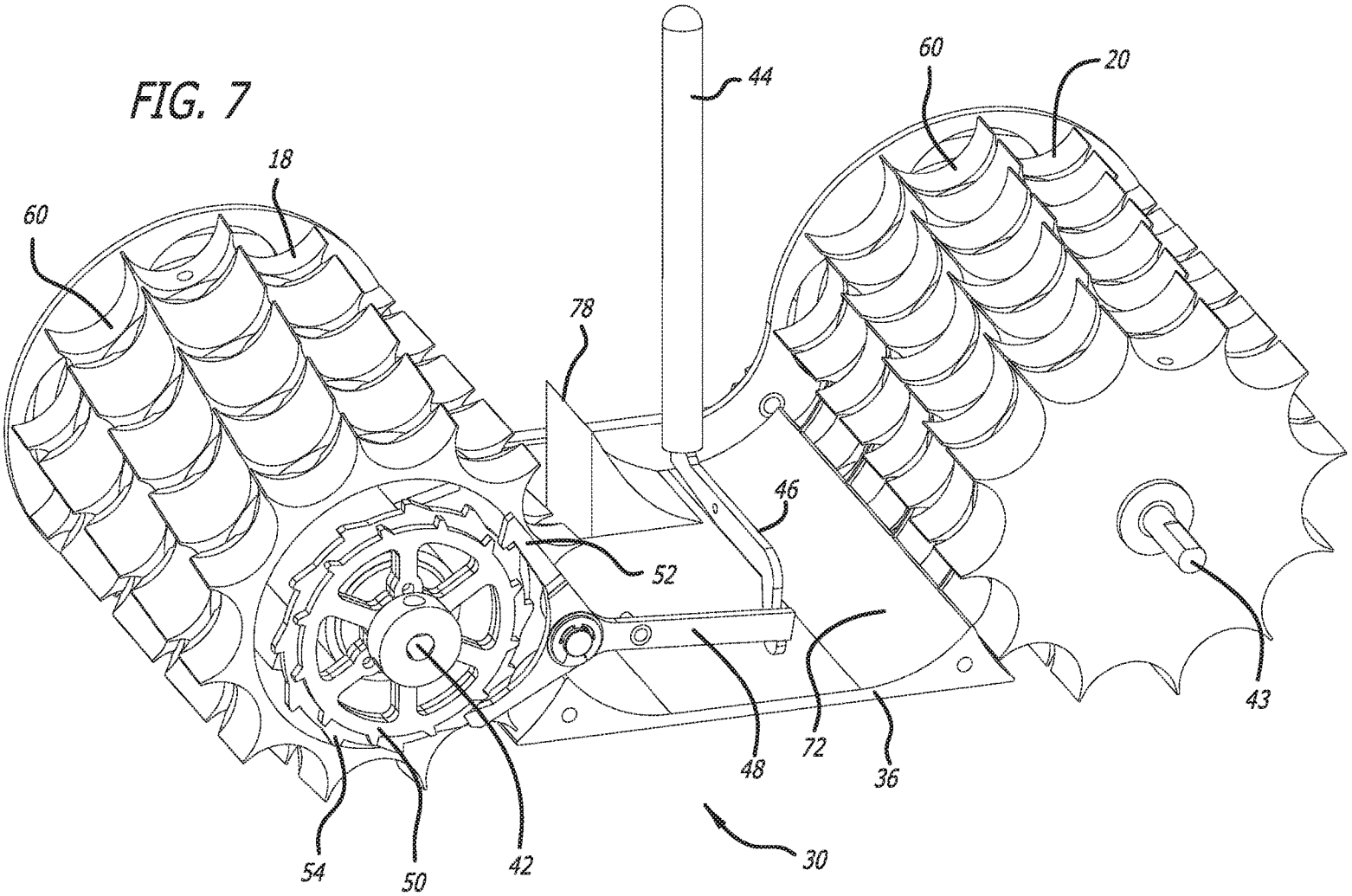
FIG. 7 is a rear perspective view of the projectile loader of FIG. 1 with the outer housing and divider housing removed.
Figure 8:
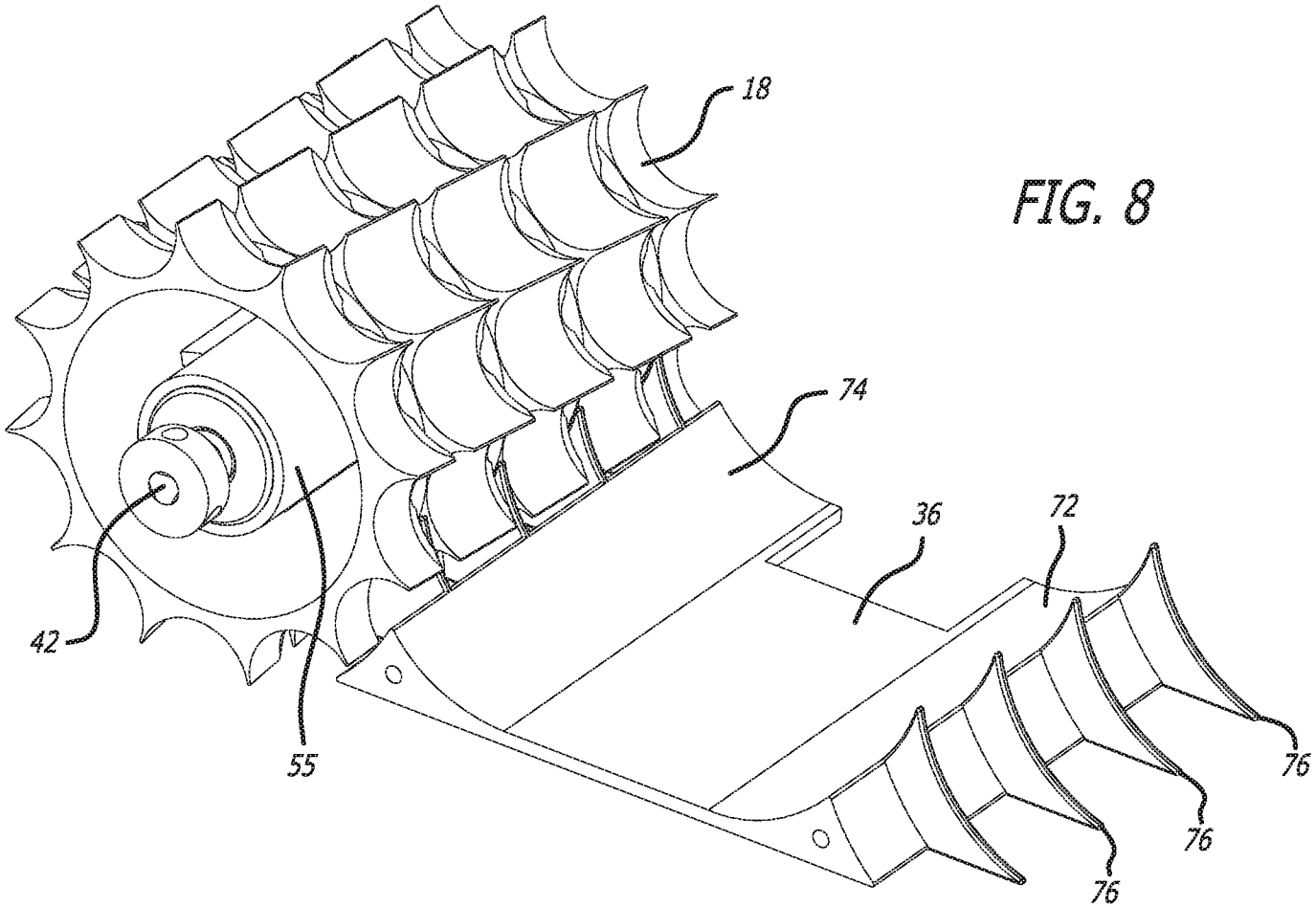
FIG. 8 is a rear perspective view of the projectile loader of FIG. 1, with the indexing assembly and second drive core removed.

Since the first drive core 18 is connected to the first drive shaft 42, when the first drive shaft 42 is indexed one unit of rotation, the first drive core 18 will correspondingly rotate one unit (i.e., one projectile). As shown in FIG. 5, the first drive shaft 42 has a drive gear 56 at the front end of the drive shaft 42. Correspondingly, the second drive shaft 43 has a drive gear 58 at the front end of the second drive shaft 43. A drive mechanism, such as a chain or belt 61 connects drive gear 56 with drive gear 58 such that as the drive gear 56 rotates one unit of rotation with the first drive shaft 42, the drive gear 58 and second drive shaft 43 will rotate a corresponding one unit of rotation. Further, since the second drive core 20 is connected to the second drive shaft 43, when the second drive shaft 43 rotates one unit of rotation, the second drive core 20 will similarly rotate one unit of rotation.

Referring to FIG. 12, in one embodiment the first drive shaft 42 is a two-part drive shaft 42, with a first portion 42*a* connected to the indexing assembly 30 and a second portion 42*b* connected to the drive gear 56. A coupling member 55 joins the first portion 42*a* of the first drive shaft 42 with the second portion 42*b* of the first drive shaft 42. The coupling member 55 operates to dampen or soften the starting and stopping of the first and second drive shafts 42, 43 due to the strong spring force of the pre-tensioning mechanism 38 and the quick indexing of the indexing assembly 30.

The first and second drive cores 18, 20 have a plurality of longitudinal concave receivers 60 about their outer circumference. The concave receivers 60 are designed to receive a variety of shapes of projectiles as shown in FIGS. 2-6, 9-11, 13-15 and 17. In one embodiment there are twelve concave receivers 60 about the outer circumference of the drive cores 18, 20. Accordingly, each unit of rotation of the drive cores 18, 20 equates to approximately 30° of rotation of the drive cores 18, 20.

The projectiles are retained in the concave receivers 60 and within a defined load path 62 with the use of the divider 22 (shown in FIGS. 3-5 and 16-17) to define the outer perimeter of the load path 62, the rear plate 26 (shown in FIG. 4) to define the rear side of the load path 62, the front plate 28 (shown in FIG. 5) to define the front side of the load path 62, and the divider walls 23 (shown in FIGS. 16 and 17) to define the internal channels of the load path 62. In one embodiment the divider 22 is a plastic component that is maintained about an exterior of the drive cores 18, 20, and which also extends between the drive cores 18, 20 to retain the projectiles in the load path 62 when the projectiles are being transferred from one drive core to the other drive core, as well as into the magazine 34 for loading into the launcher 40. Similarly, the front and rear plates 26, 28 are typically plastic components, however they may be metal components, such as aluminum, that retain the projectiles in the load path 62 at the first side and second side of the launcher 10.

Figure 17:
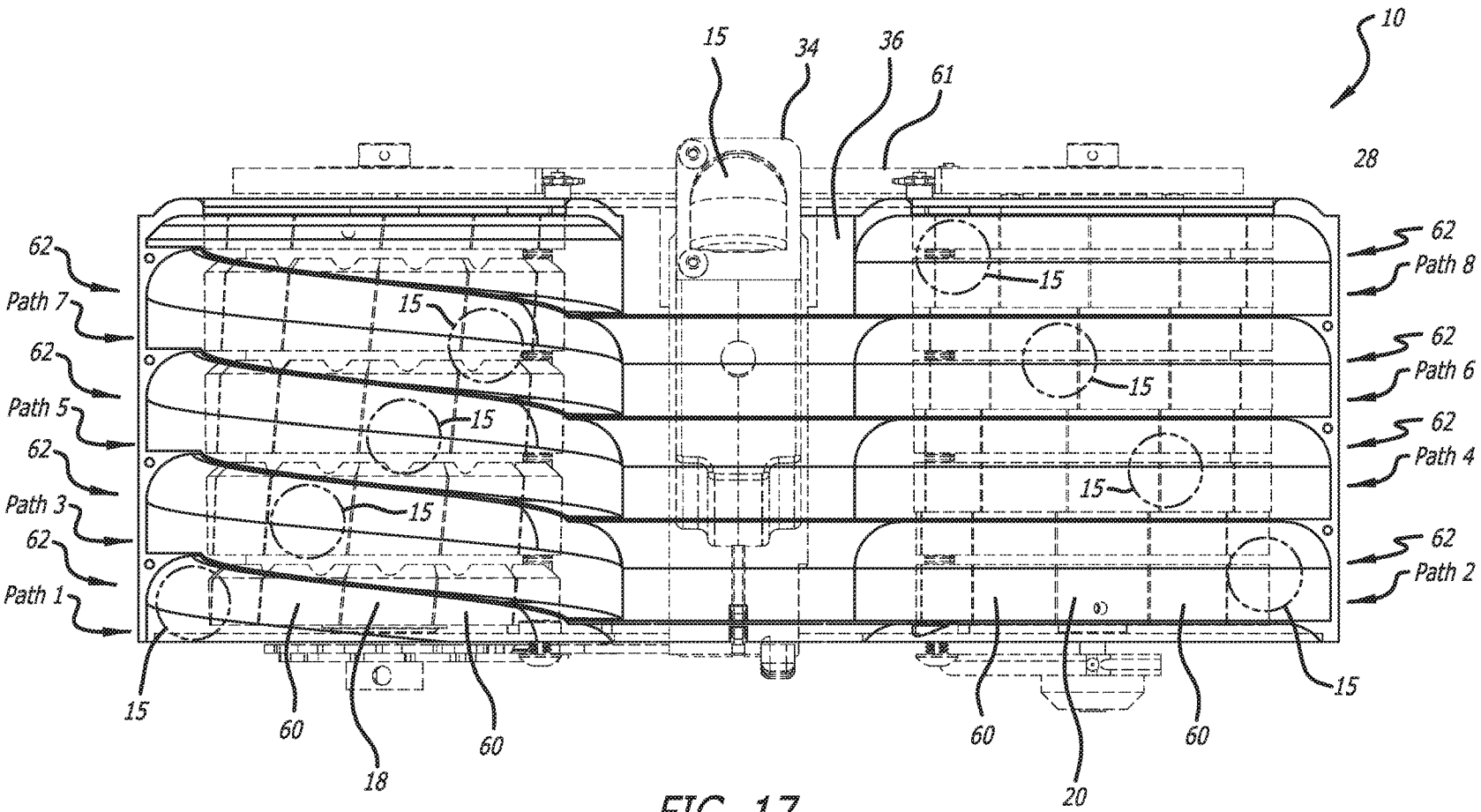
FIG. 17 is a schematic top plan view of the load paths of the projectile loader as defined by the divider walls according to one embodiment.

In one embodiment, the load path 62 of the projectiles is a semi-helical serpentine path that extends from the first drive core 18 to the second drive core 20, and back and forth four times, until the load path goes into and up the magazine 34. It is understood that the load path 62, i.e., the number of load path lanes, may be larger or smaller in number depending on the size of the loader 10 and the number of projectiles desired to be retained in the loader 10. The semi-helical serpentine path of the load path 62 is defined by the divider 22 and divider walls 23, also referred to as channel guides 23, that extend around the first and second drive cores 18, 20 and also around the loader plate 36. The divider 22 and divider walls 23 are preferably made of plastic components that may be snapped or otherwise connected together around the first and second drive cores 18, 20 as shown in FIGS. 16 and 17. The load path 62 is sized to be able to receive a plurality of different size and different shape projectiles, including projectiles that have a length that is greater than the diameter of the projectile (see for example, FIG. 17) that may be accommodated in the load path, including at the same time.

As shown in FIGS. 16 and 17, the divider walls 23 are fairly straight along the bottom of the loader 10 and around the second drive core 20, but the divider walls 23 have a helical shape around the first drive core 18 (see FIG. 17) to transition the projectiles from one lane of the load path 62 to an adjacent lane of the load path 62. In FIG. 17 the divider walls 23 are shown in solid line, whereas the drive cores 18, 20 are shown in a dashed line solely for schematic clarity purposes. Accordingly, in one embodiment the load path 62 is as follows: the projectiles start at the entrance 70 to the load path 62 which is generally at the top of the first drive core 18. The projectiles are indexed around the outer perimeter of the first drive core 18 between the helical path of the divider walls 23 (referenced as Path 1) and then in a straight line along the bottom of the loader plate 36 to the second drive core 20. They then go around the outer perimeter of the second drive core 20 in a straight rotation (referenced as Path 2) and continue in a straight line on the top of the loader plate 36 to the first drive core 18. They then are indexed around the outer perimeter of the first drive core 18 between the helical path of the spring 22 portions (referenced as Path 3) and continue in a straight line along the bottom of the loader plate 36 to the second drive core 20 where they go around the outer perimeter of the second drive core 20 in a straight rotation (referenced as Path 4). The projectiles continue in a straight line on the top of the loader plate 36 to the first drive core 18 where they are indexed around the outer perimeter of the first drive core 18 between the helical path of the spring 22 portions (referenced as Path 5) and continue in a straight line along the bottom of the loader plate 36 to the second drive core 20 where they go around the outer perimeter of the second drive core 20 in a straight rotation (referenced as Path 6). The projectiles continue in a straight line on the top of the loader plate 36 to the first drive core 18 where they are indexed around the outer perimeter of the first drive core 18 between the helical path of the spring 22 portions (referenced as Path 7) and continue in a straight line along the bottom of the loader plate 36 to the second drive core 20 where they go around the outer perimeter of the second drive core 20 in a straight rotation (referenced as Path 8). Finally, the projectiles continue in a straight line on the top of the loader plate 36 and are then diverted by ramp 78 into the magazine 34 where they continue in a straight generally vertical line up to the breach of the launcher.

The loader plate 36 has a ramp 72 adjacent the second drive core 20 to assist the projectiles in transferring from the concave receivers 60 of the second drive core 20 to the top of the loader plate 36. The loader plate 36 also has a ramp 74 adjacent the first drive core 18 to assist the projectiles in transferring from the flat top of the loader plate 36 to the concave receivers 60 of the first drive core 18. The loader plate 36 also extensions 76 to assist in transferring from the projectiles from along the bottom rotation of the first drive core 18 to along the bottom of the loader plate 36, and then from the bottom of the loader plate 36 to the rotation of the second drive core 20. And, the drive cores 18, 20 have slots to accommodate the extension 76 of the loader plate 36. Accordingly, each projectile is moved independently around the first and second drive cores 18, 20, and only during the periods of straight movement along the top and bottom of the loader plate 36 do the projectiles receive any pushing force from adjacent projectiles.

Once the projectiles are in the magazine 34 they are ready to be inserted, individually, into the breach of the launcher 40. The magazine 34 may include feed lips or spring guides that assist in placing the individual projectiles in the breach of the launcher 40, and which also preclude the projectiles from attempting to slide back into the magazine 34 of the launcher 40.

Figure 13:
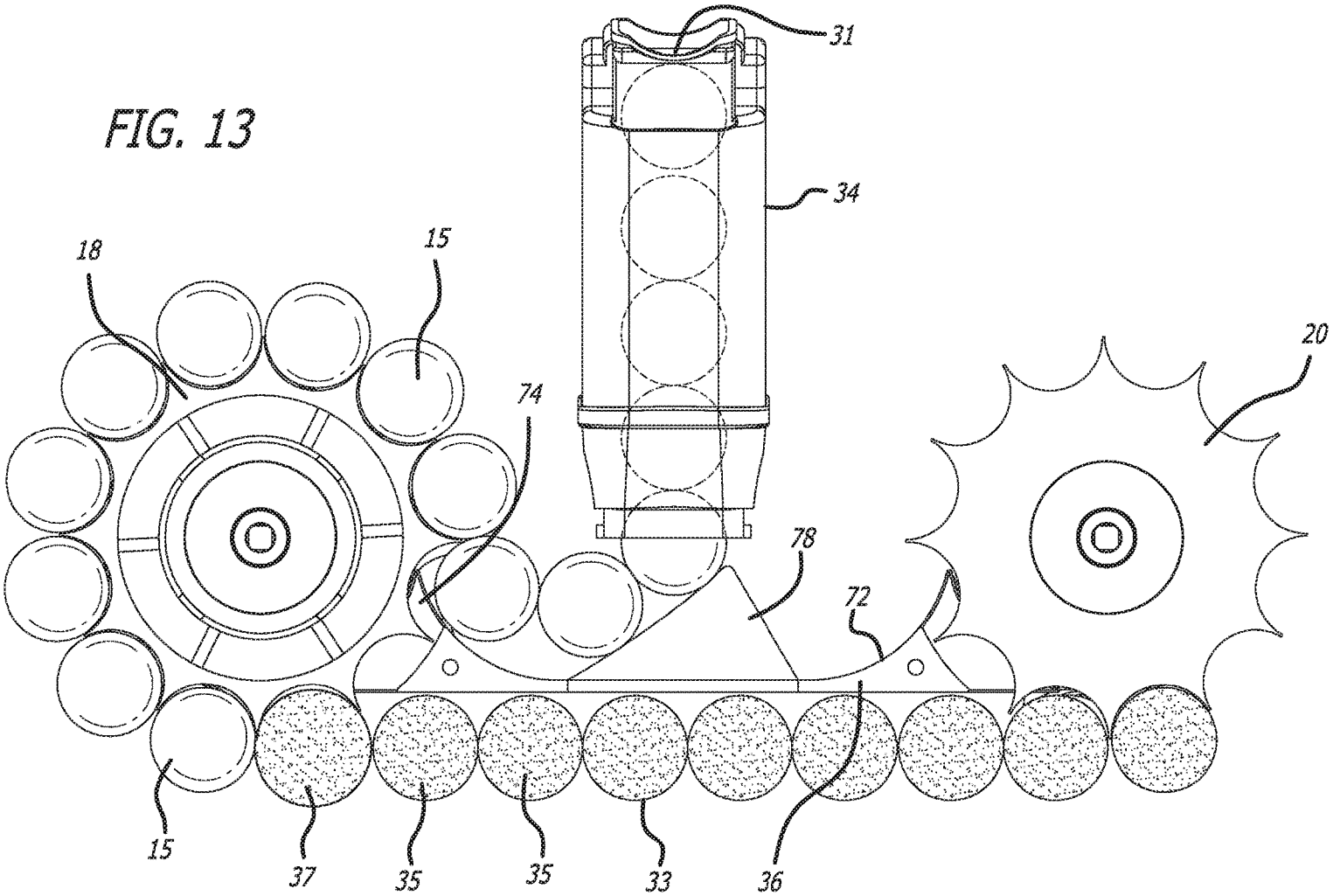
FIG. 13 is a schematic view of the load path of the projectile loader including the feed follower positioned between the first and second drive cores.
Figure 15:
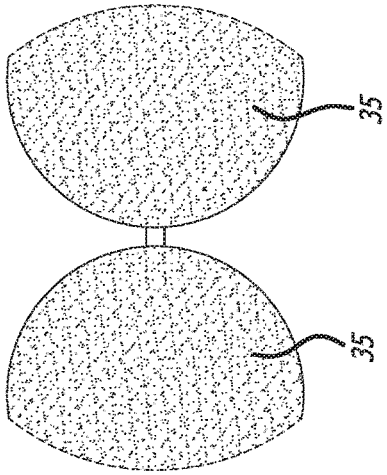
FIG. 15 is an enlarged view of the connection between adjacent components of the feed follower according to one embodiment.
Figure 14:
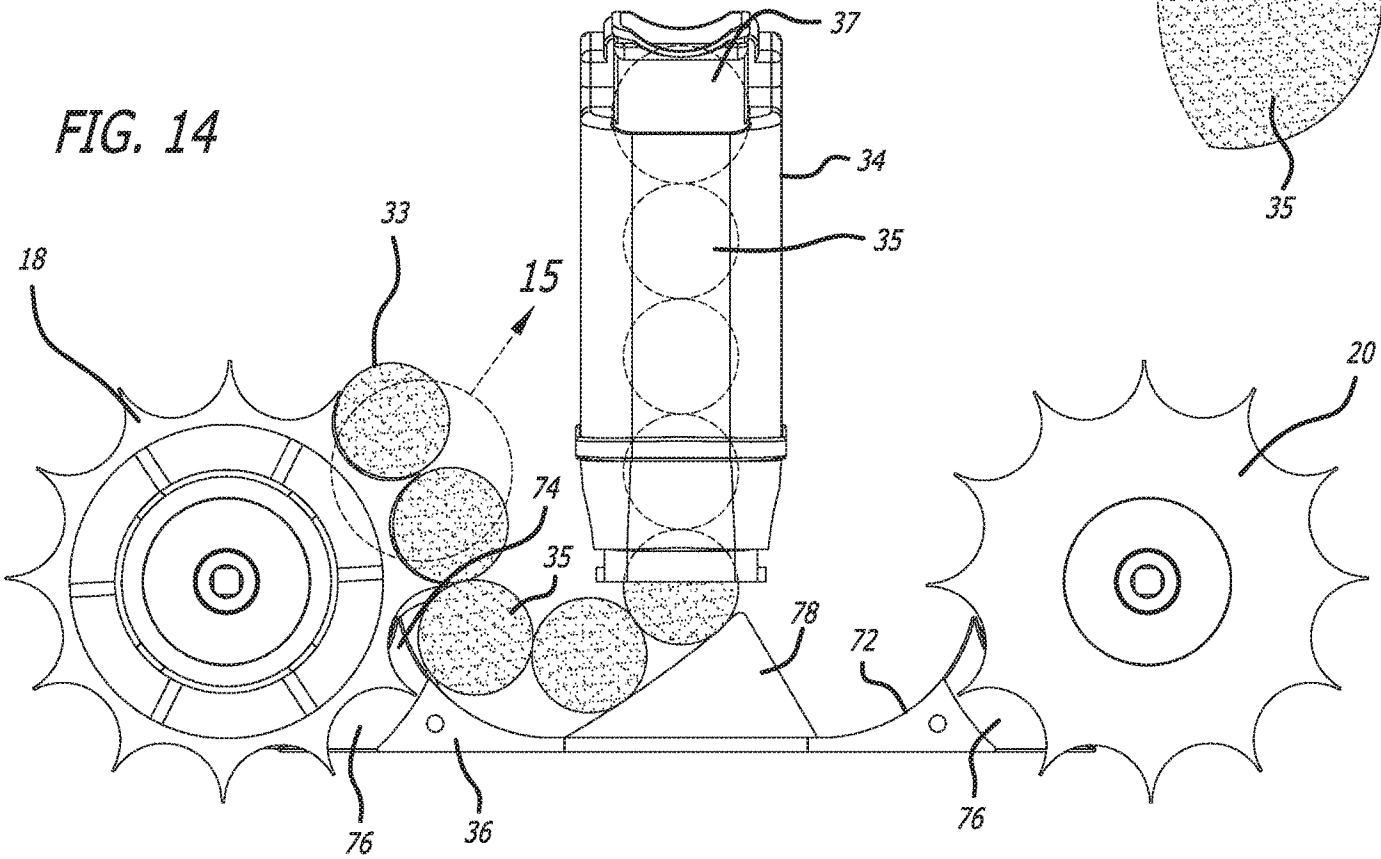
FIG. 14 is a schematic view of the load path of the projectile loader where all of the projectiles have been expelled and only the feed follower remains.

As shown in FIGS. 13-15, prior to inserting any projectiles into the loader 10, the feed follower 33 must be inserted into the loader 10. In one embodiment the feed follower 33 comprises a plurality of dummy projectiles 35 that are linked together in series, such as with a string, wire, or some other means, preferably a rigid means. The feed follower 33 allows for all of the projectiles to be dispensed from the loader 10. For example, if no feed follower 33 was provided, as the projectiles were being dispensed from the loader 10, the last projectiles that spanned the gap between the two drive cores 18, 20 would not be under any drive force and therefore they would be "stuck" in that gap and would not be able to be dispensed from the loader 10. Accordingly, by having a feed follower 33 that is at least as long at the distance between the drive cores 18, 20, typically approximately 8 to 9 projectiles, and by having the feed follower 33 semi-rigidly connected and placed behind the last projectiles in the loader 10, at least one dummy projectile 35 from the feed follower 33 will always be in contact with at least one drive core 18, 20 at all times allowing all of the projectiles to be fed out of the launcher. The last dummy projectile 37 preferably has a larger size or circumference than the exit 31 to the magazine 34. Accordingly, after all the actual projectiles are dispelled and all that remains in the launcher 10 is the feed follower 33, the leading dummy projectile 35 will not be able to pass through the opening 31 in the magazine 34 and the user will know that all of the projectiles have been dispelled when the launcher 10 does not shoot any more projectiles following the trigger being actuated.

Several alternative embodiments and examples have been described and illustrated herein. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. Additionally, the terms "first," "second," "third," and "fourth" as used herein are intended for illustrative purposes only and do not limit the embodiments in any way. Further, the term "plurality" as used herein indicates any number greater than one, either disjunctively or conjunctively, as necessary, up to an infinite number. Additionally, the term "having" as used herein in both the disclosure and claims, is utilized in an open-ended manner.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein. Accordingly, while the specific embodiments have been illustrated and described, numerous modifications come to mind without significantly departing from the spirit of the invention and the scope of protection is only limited by the scope of the accompanying Claims.

What is claimed is:

1. A high capacity loader for sequentially loading a plurality of projectiles into a launcher, comprising:

an outer housing;

a first drive core in the outer housing rotating on a first drive shaft;

a second drive core in the outer housing rotating on a second drive shaft, the second drive core being adjacent the first drive core, the second drive core rotationally connected to the first drive core;

a front plate providing an internal closure at a first side of the loader;

a rear plate providing an internal closure at a second side of the loader;

a divider to retain the projectiles in a defined load path around the first and second drive cores;

an indexing assembly that indexes the first and second drive cores;

a drive assembly that provides a rotational force for the first drive core and the second drive core, the drive assembly rotationally connecting the first drive shaft to the second drive shaft and providing a drive force to rotate the first drive shaft and second drive shaft; and, a magazine adapted to connect the outer housing to the launcher and to feed the projectiles in the loader into the launcher.

2. The high capacity loader of claim 1, wherein the projectiles in the load path are not under compression or tension force around the first and second drive cores.

3. The high capacity loader of claim 1, wherein the high capacity loader is maintained in an indexing state during use and during of non-use.

4. The high capacity loader of claim 1, further comprising a loader plate to transition the projectiles from the load path into the magazine.

5. The high capacity loader of claim 1, wherein the first and second drive cores have a plurality of concave receivers about a circumference of the first and second drive cores, respectively.

6. The high capacity loader of claim 1, wherein the outer housing comprises a front outer housing and a rear outer housing that are secured together.

7. The high capacity loader of claim 1, wherein the divider comprises a plurality of channel guides and an outer guide.

8. The high capacity loader of claim 1, wherein the indexing assembly is provided adjacent the second side of the loader.

9. The high capacity loader of claim 8, wherein the indexing assembly has an actuator in the magazine that is driven by the launcher, and wherein the indexing assembly further has a rachet mechanism that indexes the first drive core.

10. The high capacity loader of claim 1, wherein the drive assembly comprises a spring around one of the first and the second drive shafts, and wherein the spring is loaded during insertion of the projectiles into the loader.

11. The high capacity loader of claim 1, wherein the drive assembly comprises a spring loaded drive on the second drive shaft, and a drive belt connecting the second drive shaft and the first drive shaft.

12. The high capacity loader of claim 1, wherein the first drive shaft and the second drive shaft are connected to the front plate and rear plate, respectively, to retain the first drive shaft, with the first drive core attached thereto, and the second drive shaft, with the second drive core attached thereto, in the appropriate locations.

13. The high capacity loader of claim 1, further comprising a feed follower comprising a plurality of dummy projectiles connected to one another in series, the feed follower being inserted into the load path.

14. The high capacity loader of claim 13, wherein the first projectile of the feed follower has a larger shape to be captured in the magazine prior to exit from the magazine.

15. A high capacity loader for sequentially loading a plurality of projectiles into a launcher, comprising:

a housing;

a first drive core in the housing, the first drive core having a load path to maintain the projectiles in a defined path around the first drive core;

a second drive core in the housing and adjacent the first drive core, the second drive core rotationally connected to the first drive core, and a load path defined by dividers to retain the projectiles in a defined path on the first and second drive cores;

an indexing assembly for indexing the first drive core;

a drive assembly for providing a rotational force for the first drive core; and, a magazine extending from the housing to connect the loader to the launcher and to load the projectiles into the launcher, wherein the projectiles are individually indexed on the first drive core and are free from loading by adjacent projectiles on the first drive core.

16. The high capacity loader of claim 15, further comprising a loader plate to transition the projectiles into a magazine extending from the housing.

17. A high capacity loader for sequentially loading a plurality of projectiles into a launcher, comprising:

a first drive core;

a second drive core and adjacent the first drive core, the second drive core rotationally connected to the first drive core, the first and second drive cores having a plurality of longitudinal concave receivers about their circumferences;

a load path to maintain the projectiles in a defined path around the first and second drive cores;

an indexing assembly for indexing the first and second drive cores;

a drive assembly for providing a rotational force for the first and second drive cores; and, a magazine extending from the housing to connect the loader to the launcher and to load the projectiles into the launcher, wherein the projectiles are individually indexed on the first and second drive cores and are free from force by adjacent projectiles on the drive cores.

18. The high capacity loader of claim 17, wherein the load path is defined by a divider on an exterior of the drive cores.

19. The high capacity loader of claim 17, wherein the load path has a helical shape around the drive cores.

* * * * *